United States Patent [19]

Nowisch et al.

[11] Patent Number: 5,014,924

[45] Date of Patent: May 14, 1991

[54] APPARATUS AND METHOD FOR ROLL CHANGING ON A CONTINUOUS WINDER

[75] Inventors: Heinz K. Nowisch; Richard S. Tetro, both of Fulton, N.Y.

[73] Assignee: The Black Clawson Company, Middletown, Ohio

[21] Appl. No.: 396,191

[22] Filed: Aug. 21, 1989

[51] Int. Cl.[5] ..... B65H 19/20; B65H 35/04

[52] U.S. Cl. ..... 242/56 R; 242/56.6; 242/56.2

[58] Field of Search ..... 242/56 R, 56.4, 56.6, 242/56.2, 56 A; 83/177, 701, 936, 937

[56] References Cited

U.S. PATENT DOCUMENTS

| | | | |
|---|---|---|---|
| 3,891,157 | 6/1975 | Justus | 242/56.2 |
| 4,007,652 | 2/1977 | Shinomiya et al. | 83/106 |
| 4,182,170 | 1/1980 | Grupp et al. | 83/177 |
| 4,266,112 | 5/1981 | Niedermeyer | 219/121 |
| 4,435,902 | 3/1984 | Mercer et al. | 30/296 |
| 4,552,316 | 11/1985 | Dropczynski et al. | 242/56 R |
| 4,695,004 | 9/1987 | Grossmann et al. | 242/56 R |

FOREIGN PATENT DOCUMENTS 1293563 4/1969 Fed. Rep. of Germany .

OTHER PUBLICATIONS

Papermaking—Automating Reel, Winder Operations Cuts Work Load, Raises Production—Pulp & Paper, Apr. 1979, pp. 104–109.

*Primary Examiner*—Daniel P. Stodola
*Assistant Examiner*—Joseph A. Rhoa
*Attorney, Agent, or Firm*—Biebel, French & Nauman

[57] ABSTRACT

In a winder for continuously winding a web material into rolls on successive cores, roll changing apparatus for cutting and transferring the web material from a full roll to an empty core includes two sets of water jet nozzles mounted for reciprocating movement in opposite directions lengthwise of the core to which the web is to be transferred. During the momentary interval of roll changing, the oppositely moving jets cut the web along a generally saw tooth pattern, and at the same time, the water which cuts the web also wets its cut leading end and the adjacent surface of the core, thereby causing adhesion of the end of the web to the core for a sufficient interval for this end of the web to be covered by the next wrap on the core.

6 Claims, 4 Drawing Sheets

44
24
23
21
57
22
51
50
52
25
25
37
37
20
38
35
35
11
11

APPARATUS AND METHOD FOR ROLL CHANGING ON A CONTINUOUS WINDER

BACKGROUND OF THE INVENTION

A winder of present day construction for continuously winding web material into rolls is usually equipped with roll changing apparatus which is manually or automatically actuated to cut the web between a fully wound roll and an empty core, and to effect a connection between the resulting cut leading end of the web and the core that will cause the web to start winding on the new core.

It is highly desirable that this operation of roll changing be carried out in such manner that there is minimum possibility of the cut leading end portion of the web folding on itself and creating a ridge on the core over which subsequent layers of web material are wound. For example, when the web is attached to the core by a strip of adhesive tape prelaid on the core, it is important that there be a minimum amount of web between the cut leading end of the web and the strip across the web which is attached to the new core, to prevent fold-back of that leading end of the web. A zero fold-back start of each new roll is especially important with stretchable web materials, such as stretch wrap and shrink wrap plastics, because fold back on the new core can cause bulges in the roll which seriously affect the quality of the web material for subsequent use.

One of the factors affecting the start of each new roll on a core is the method or means by which the web is cut in the course of roll changing. It is common to use a knife for this purpose, such particularly as a serrated blade, and typical examples of knives for this purpose are shown in the co-owned U.S. Pat. Nos. to Phelps et al. No. 3,841,577 and No. 4,326,679, and Tetro No. 4,422,586.

In the apparatus of each of those patents, some means are required for aiding the knife in causing the cut leading end of the web to begin winding on the new core. Thus in U.S. Pat. Nos. 3,841,577 and 4,422,586, each core must be "prepared" by being provided with a strip of adhesive extending lengthwise thereof to which the web will adhere, and in U.S. Pat. No. 4,326,679, a curved shoe guides the cut leading end of the web directly from the knife into the nip between the new core and the pressure roll.

It is also old and well-known in the web handling arts, including the making and handling of paper webs, to employ water jets for slitting or otherwise cutting the continuously moving web. Nevertheless, it is believed to be novel to employ water jets in roll changing apparatus for a continuous winder as described hereinafter.

SUMMARY OF THE INVENTION

It is a primary object of the present invention to provide a roll changer which is usable with all types of continuous web materials, including paper and paperboard as well as plastic films, and which will effect each successive roll change from a full roll to an empty core in such manner as to eliminate all possibility of fold-back at the start of the new roll. It is a particular object of the invention to achieve its basic objective by utilizing multiple water jets to effect both the cutting of the web and the adhesion of the cut leading end of the web to the new core.

In the practice of the invention, each successive new core is brought into supporting relation with the run of the web to a winding roll, and at the correct interval for a roll change, multiple water jet nozzles on the opposite side of the web from the new core are caused to move lengthwise of the core very rapidly while directing jets against the portion of the web wrapping the core. This operation has twin results in that not only does it effect crosswise severing of the web within a very limited linear extent of the web, but it also attaches the resulting cut leading end of the web to the core.

More specifically with respect to the latter result, while the volume of water discharged by the jets is relatively small, such water as there is will be absorbed by the portions of the core against which each jet nozzle cuts the web, and there will also usually be some minor degree of cutting of the core itself. With some web materials, such particularly as non-woven fabrics, it has been found that the cut leading edge of the web will be forced into the core, while with webs of continuous plastic materials, such as stretch wrap and shrink wrap plastics, the wetting of the core and the edge portion of the web will cause them to stick together at least long enough until the junction between the web and core has been covered by the first complete wrap of the web as the winding of the new roll proceeds. The net result in each case is therefore that it is the cut edge of the web which is directly adhered to the core, so that no fold-back can occur.

In order to appreciate one of the major advantages of the invention, it is necessary to recognize that whenever a linearly moving web is severed by a knife or other part which moves laterally of the web, rather than by a knife blade which extends across the full width of the web, the resulting cut will necessarily define an oblique angle with the edges of the web, and this will result in waste web material consisting of all of the material bordered by the oblique cut. The angle defined by such a cut line and the edges of the web will depend upon the ratio of web speed to the speed of the cutting member, and at web speeds of the order of 1,000 feet per minute, which are common, it would be difficult to the point of being impractical to move a knife across the web at a speed which came even close to producing a right angle between the cut line and the edges of the web.

The present invention provides an effective solution to this problem by utilizing as the web-severing means, multiple water jet nozzles spaced relatively closely across the width of the web so that the stroke of each nozzle, and therefore the time required for that stroke, will be correspondingly less than the time consumed by a single cutting member moving the full width of the web. In addition, the jet nozzles are arranged in sets which move in opposite directions and thereby further reduce the time necessary for cutting the web across its entire width.

An important result of this practice is that with multiple nozzles moving in opposite directions, the cut across the web has a saw tooth configuration which provides a series of triangular tongues along the cut leading end of the web which is to be attached to the new core. These tongues are individually quite flexible, particularly on relatively stiff web materials as compared with a straight cut across the web, and they are correspondingly relatively easy to adhere to the core by means of the water which effects the cutting and also wets the core surface along which the cut is made. This result is also aided by the fact that the tongues provide a correspondingly longer edge across the web than would a straight cut.

Another major advantage of the invention lies in the simplicity of the parts utilized to effect the roll change, and the ease and speed with which they can be replaced whenever that may be necessary. More specifically, where mechanical knives need frequent sharpening or replacement, especially in dealing with tough web materials, the only parts employed in practicing the invention which are subject to wear are the orifices of the jet nozzles, and depending upon the materials of which they are made, they will far outlast knife blades. Further, if a jet orifice does become worn to the extent that its replacement is needed, that will commonly take no more than of the order of five minutes.

Other objects and advantages of the invention, and specific means by which they are achieved and provided, will be apparent from or pointed out in the course of the description of the preferred embodiment which follows.

DESCRIPTION OF THE PREFERRED EMBODIMENT

Figure 1:
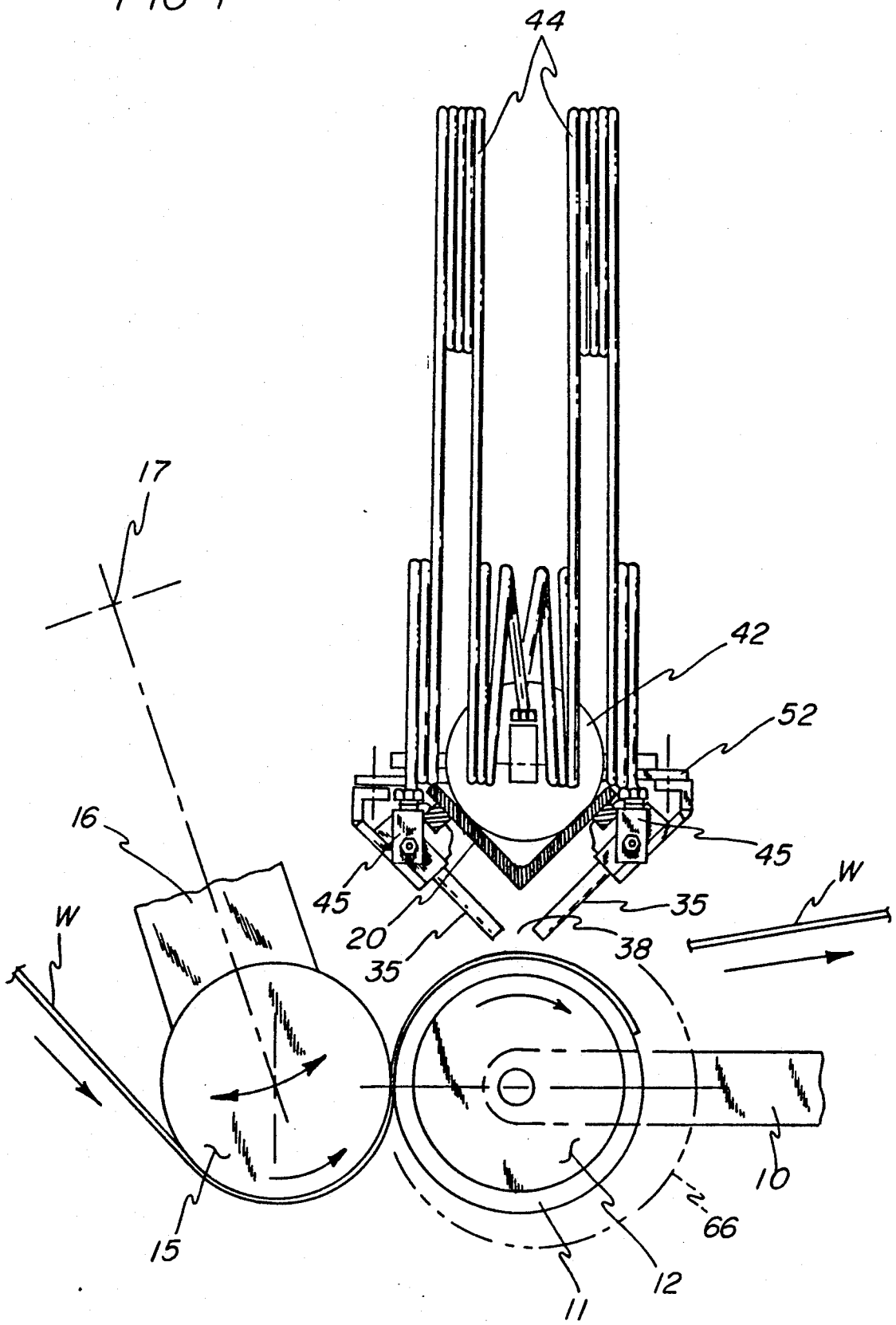
FIG. 1 is a somewhat diagrammatic view, partially in section on the line 1—1 of FIG. 2, illustrating the essential parts of roll changing apparatus in accordance with the invention.

FIG. 1 illustrates roll changing apparatus in accordance with the invention in combination with a conventional continuous winder, which is shown fragmentarily as including turret arms 10 for supporting an empty core 11 (usually a paperboard) and a winding roll (not shown) at their opposite ends, the core 11 being on a conventional core shaft 12. The web W being wound is shown as guided to the winder under a pressure roll 15 carried by arms 16 which have a pivotal mounting 17 on the end stands of the winder or roll changer, and which are biased in the usual way to maintain yieldable pressure between roll 15 and the core 11 or the web material winding on that core. Alternatively, the pressure roll may be mounted on separate roll changer end stands movable linearly with respect to the winder and biased toward the winder, as by fluid pressure cylinders.

Figure 3:
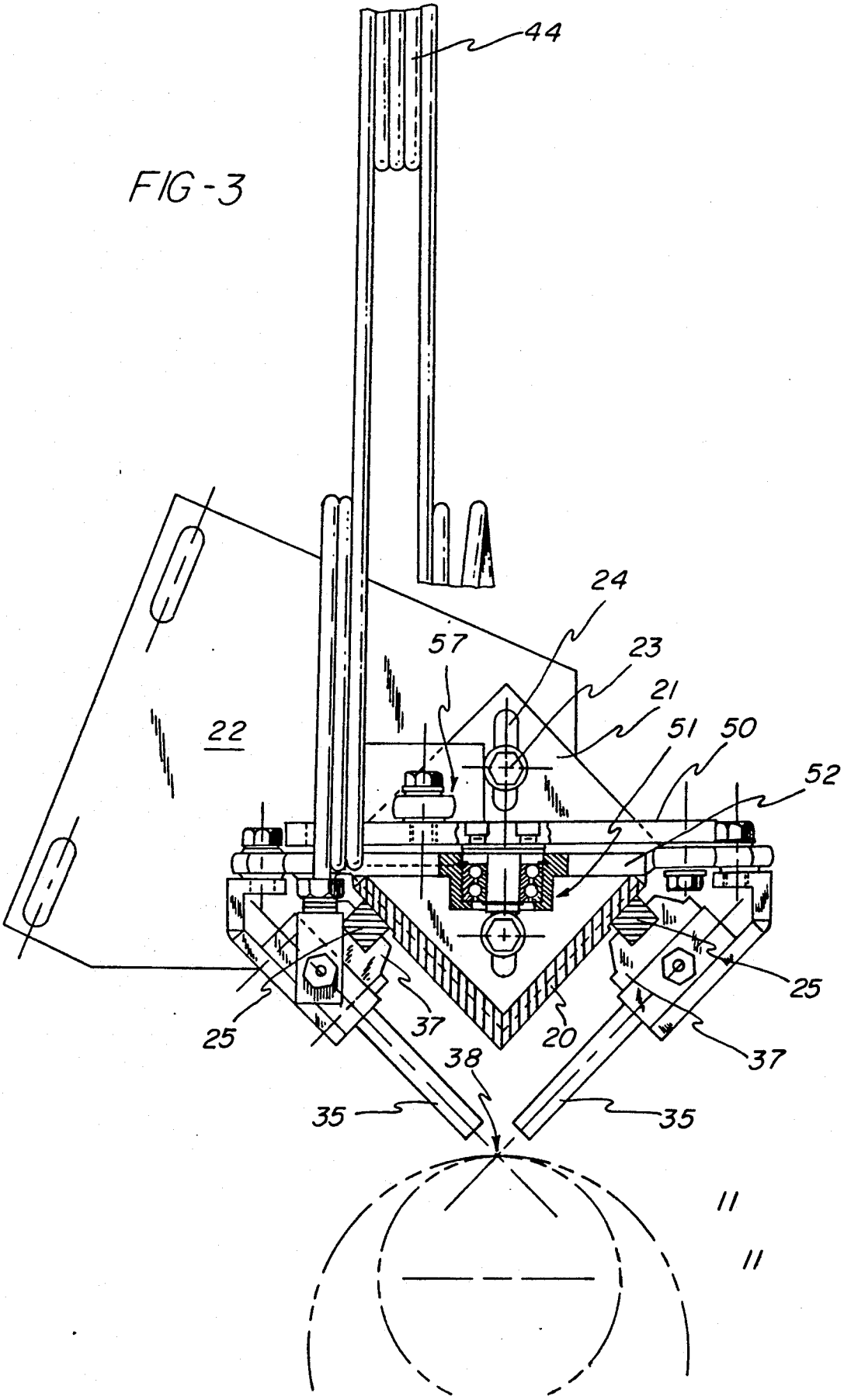
FIG. 3 is an enlarged section on the line 3—3 of FIG. 1.

FIG. 1 shows these parts in position for roll changing, after the arms 10 have moved a substantially fully wound roll to the opposite side of their pivotal mounting so that the new core 11 has been raised to a position where it supports and is partially wrapped by the web W traveling to the full roil at the other end of arms 10. After the web has been cut and transferred to the new core 11, the full roll will be removed and replaced by another core in preparation for the next roll change. FIG. 3 shows in broken lines cores 11 and 11' of different sizes.

The roll changing apparatus of the invention includes a main supporting V-beam 20 provided at each end with a flange 21 (FIGS. 2 and 3) attached to a plate 22 by which it is mounted on the end stands of the associated winder or on separate roll changer end stands. It will be understood that the mounting for the beam 20 should provide for its movement between the operating position shown in FIG. 1 and a rest position wherein it is out of the way of the swinging movement of a roll or core carried by arms 10. As illustrated by the bolts 23 and slots 24 in FIG. 3, the flanges 21 may be adjusted on their mounting plates 22.

As best seen in FIG. 3, two sets of water jet nozzle assemblies are supported for reciprocating movement lengthwise of the beam 20, on rails 25 adjacent the opposite edges of beam 20. These nozzle assemblies are designated in FIG. 4 as 30*a*–30*c* in one set and 30*d*–30*f* in the other set. Each includes a T-fitting 33 and a jet nozzle 35 extending therefrom. Since it is necessary that each nozzle in one set line up with or pass one or two nozzles in the other set, the respective nozzles are mounted with their discharge ends sufficiently offset from those in the other set lengthwise of the web direction to provide for such relative movements.

The several fittings 33 in each set are connected together by high pressure tubing 36 in uniformly spaced relation lengthwise of the core 11, and each fitting 33 is mounted by a linear bearing 37 (FIG. 3) for sliding movement on the adjacent rail 25. In this way, the two sets of nozzles 35 are inclined in opposite directions so that they are all aimed at the same line 38 extending lengthwise on core 11, which is preferably, although not necessarily, in the plane through the central axis of core 11 that bisects the angle defined by the opposed sets of nozzles 35. The jets from both sets of nozzle assemblies therefore combine to define the common line 38 extending lengthwise of the surface of core 11.

Figure 4:
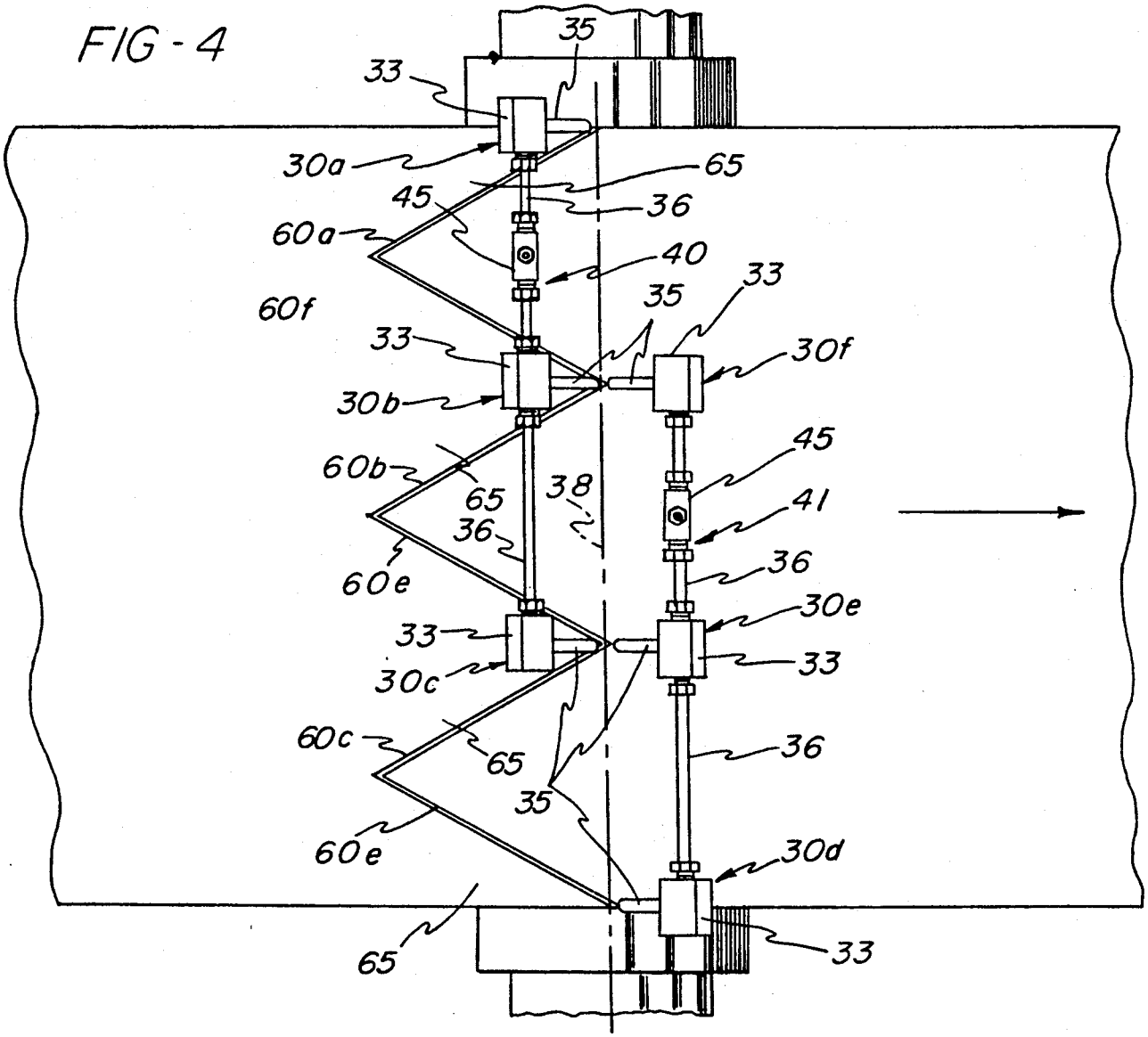
FIG. 4 is a somewhat diagrammatic plan view illustrating the operation of the form of the invention shown in FIGS. 1-3.

Each of these sets of nozzle assemblies 30*a*–30*c* and 30*d*–30*f* and their interconnecting tubing thus form a manifold designated in FIG. 4 as 40 and 41 respectively, and each of these manifolds is supplied with high pressure water through a common shut-off valve 42 (FIG. 2) mounted on beam 20 and connected to a line 43 leading from any suitable source (not shown). The high pressure water flows from the outlet port of valve 42 to each manifold by way of a safety pin shaped coil 44 (FIGS. 1 and 3) of high pressure tubing, and each of these coils is connected at its outlet end by a T-fitting 45 into one of the lengths of tubing 36 in the adjacent manifold 40 or 41.

Figure 2:
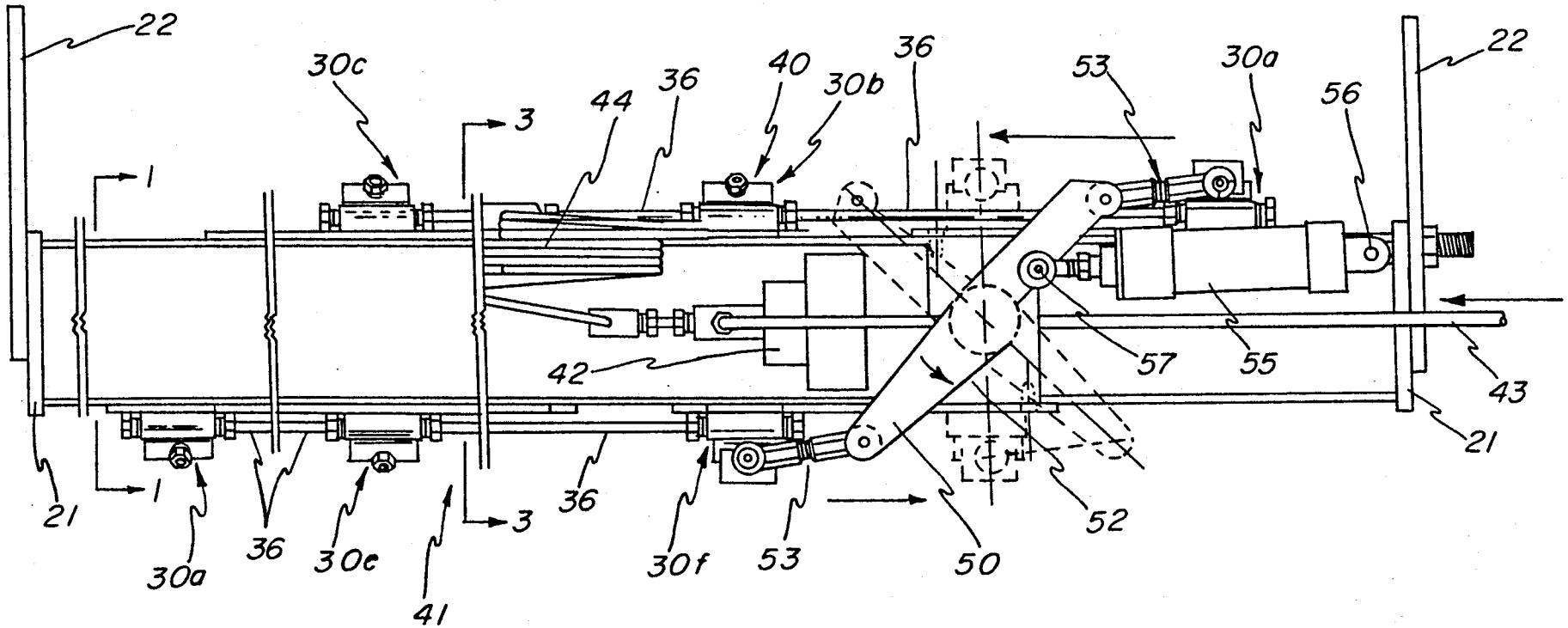
FIG. 2 is a plan view of the apparatus shown in FIG. 1.

By reason of this coil arrangement, each of manifolds 40 and 41 is free to move along the rails 25, and means are provided for positively driving them in opposite directions. Referring particularly to FIG. 2, a double-ended lever 50 is mounted for oscillating movement on the beam 20 by a bearing assembly 51 on a plate 52 (FIG. 3) which is in turn secured to the opposite sides of the V-beam 20.

Each end of the lever 50 is pivotally connected to one or the other of the manifolds 40 and 41, by means such as an adjustable ink 53 shown as having its opposite end connected to the nozzle assembly 30*c* or 30*f*. Arm 50 is in turn oscillated about its pivotal mounting by a double-acting fluid pressure cylinder 55 having a pivotal mounting 56 at one end on the beam 20 and a pivotal connection 57 at the other end to the arm 50. Thus oscillating movement of arm 50 will cause reciprocating movement of the manifolds 40 and 41 in opposite directions longitudinally of the beam 20.

The number and relative spacing of the nozzle assemblies in each manifold and the speed of their cutting movements are related to the desired linear speed of the web W and the width of that web. More specifically, and as explained hereinabove, whenever a web moving in one direction is severed by a member moving from side to side across the web, the line of the resulting cut will necessarily have an oblique relation to the length of the web, because the web continues to advance as it is being severed. Also necessarily, the web material bordered by an oblique cut constitutes waste, and it is therefore desirable to maintain the cutting angle as large as possible with relation to the length of the web.

Preferably, the oblique cutting line should lie within one revolution of the core, so that if, for example, the diameter of the core is 4 inches and its circumference is therefore slightly over 1 foot, the cut should be completed within 1 foot of linear movement of the web. This, however, would require that any single cutting device move across the web at many times the web speed. For example, at a linear speed of 1,000 feet per minute for an 8-foot web and a 4-inch core, the cut would have to be completed within 60 milliseconds.

This practical problem has been addressed and solved by the present invention by its provision of multiple jets which combine to execute a complete cross cut of the web while each jet is required to move only a small fraction of the total web width. Thus in the example illustrated in FIG. 4, if it is assumed that the web is 3 feet wide and travels at 1,000 feet per minute, the nozzles 30*a*–30*c* may be spaced on 1-foot centers, as also are the nozzles 30*d*–30*f*. Also, the stroke of the cylinder 55 and the connections between each manifold and the lever 50 are so set that one limit position for nozzle assemblies 30*c* and 30*d* will be at the opposite edges of the web W, as shown in FIG. 4, and the length of travel of each manifold will be 6 inches.

FIG. 4 illustrates the operation of an embodiment of the invention in accordance with these assumed dimensional relationships and operating conditions. It is also assumed that the starting positions of the two sets of nozzle assemblies, which constitute one set of their respective limit positions, are as illustrated in FIG. 4, so that the nozzles 30*a*–30*c* will move downwardly of the sheet while the nozzles 30*d*–30*f* are moving upwardly in their respective cutting strokes.

The result as illustrated will be that nozzle assemblies 30*a* and 30*f* will move toward each other and thus combine with the forward motion of the web to produce a pair of cuts 60*a* and 60*f* which will meet to define a V-cut. Simultaneously, the other two pairs of opposed nozzle assemblies will produce similar V-cuts 60*b*–60*e* and 60*c*–60*d*, resulting in a saw tooth cut 60*a*–60*f* extending across the whole width of the web. The particular angles between adjacent cuts will of course depend upon the relative speeds of the nozzle assemblies and the web, so that as the ratio of nozzle speed to web speed increases, these angles will increase and correspondingly flatten the saw tooth cut line.

FIG. 4 also illustrates how the movement of each nozzle assembly is between two limit positions, and with two exceptions, each of these limit positions is shared with a nozzle in the other manifold. More specifically, the nozzle assemblies 30*a* and 30*d* have first limit positions adjacent the opposite edges of the web which are not shared by another nozzle assembly, but the other two pairs of nozzle assemblies 30*b* and 30*f*, and 30*c* and 30*e* share limit positions in FIG. 4. The other limit positions for all of the nozzles correspond to the three points where the respective pairs of cuts 60*a*–60*f* meet, so that each of nozzles 30*a*–30*c* shares its other limit position with nozzle 30*f*, 30*e* or 30*d* respectively.

In a typical roll changing operation, the turret arms 10 or other moving supports for the new core shaft are brought into a position such as is shown in FIG. 1 wherein the core is in pressure engagement with the pressure roll 15 through the run of web W which is still traveling to the winding roll around pressure roll 15, and which partially wraps and is supported by that portion of the core directly opposite the jet nozzles 35. Also, before the roll change is made, the core 11 is caused to rotate at the same surface speed as the web, by engagement with the web and/or by a separate conventional drive through the turret arms 10.

In order to make the roll change, the water valve 42 is opened and the pressure cylinder 35 is actuated in such timed relation that as soon as the water jets begin to discharge towards the core, the manifolds 40–41 will start their respective strokes in opposite directions lengthwise of the core, thereby producing the saw cut illustrated in FIG. 4. The valve 42 is in then immediately closed to stop the cutting action of the jets as soon as the manifolds reach their other limit positions.

An important advantage of the invention will become apparent upon comparison of the saw tooth cut line in FIG. 4 with the shape of the cut line which would be produced by a single cutting device moving across the web at the same linear speed as is represented by the angle between each cut in FIG. 4 and the edge of the web. The result would be an extension of the line 60*a* or 60*d* to the opposite edge of the web W, and that resulting line would clearly be many times longer than the width of the web. This in turn would mean that all of the web material bordered by that cut line, both at the tail of the full roll and the beginning of the new roll, would be waste. In addition, all of that waste material would be wound on the core at the start of each roll, and would constitute a corresponding uneven base on which the good web material would then be wound.

In contrast, and as illustrated in FIG. 4, the present invention provides for reducing the waste to the total amount of interfitting triangular tongues 65 of web material along the saw tooth cut line, and under the assumed conditions of the above example, this would amount to a total of no more than 1 foot. Further, this advantage of the invention is in no way limited by the width of the involved web, since the only necessary adjustment would be to increase the number of nozzle assemblies in each manifold in accordance with the web width, i.e. a total of 12 nozzle assemblies for a 6-foot web under the same assumed other conditions.

Another major advantage provided by the invention is that in addition to cutting the lines 60*a*–60*f*, the water jet from each nozzle assembly will wet the leading edge of the web cut thereby and also the surrounding area of the core. The mutual adhesive effect which naturally results from these conditions will cause the leading edge of the web to adhere to the core for at least a sufficient interval for a complete revolution of the core and the resulting application of a second layer of the web material over the edge of the web on the core. Further, it is the web material bordering and including the leading edges of the tongues 65 which is adhered to the core, and as noted above, with some web materials such as non-wovens, the leading edges may be actually driven into the core. In either case, there is therefore no possibility of a forwardly extending non-attached strip of web capable of being folded back.

Referring to FIG. 4, with the nozzle assemblies starting from the illustrated limit positions, it will be seen that, for example, the initial action of the assembly 30*a* is to separate the sharp leading end of a tongue 65, and similarly the sharp leading end of the next tongue 65 will be cut during the initial movements of the nozzle assemblies 30*b* and 30*f*. Thus the leading points of each of these tongues will initially be separated from the trailing end of the web and urged into adhesive engagement with the core, even before the cut has been completed. Also, it is not necessary to return the two manifolds 40–41 to their starting positions before the next roll change, at which time they will cut three complete identical triangular tongues on the leading end of the web rather than the two complete tongues and two half-tongues illustrated in FIG. 4.

A different practical advantage provided by the invention is that in every instance, the location on the web along which it is cut will be the same, since although the core will turn and the web will move linearly during cutting, the actual cutting will take place along the line 38 defined by the two sets of oppositely inclined jet nozzles. This condition is independent of web tension and web speed. Also, it eliminates problems which are commonly attendant to cutting by a stationary knife, for example in accordance with U.S. Pat. No. 4,422,586, with film materials which have a high degree of stretchability, and which therefore tend to hang up on the knife blade and stretch to a considerable extent before they are severed. In contrast, using commercially available jet orifices, the cutting of even a highly stretchable plastic or elastomeric film will be immediate and clean as the jet moves across the web.

The adhesion effected between the cut leading end of the web and the core in the practice of the invention is most consistent, as well as most desirable, with thin and flexible web materials. However, the cutting action in accordance with the invention is effectively independent of the nature of the web material, and its advantages can be enjoyed with stiffer webs, such for example as paperboard, by equipping the roll changer with guide means for directing the cut leading end of the web into the nip between the new core and the pressure roll, such as a somewhat spirally curved shoe 66 shown in broken lines in FIG. 1.

Even if the web material is relatively stiff, the initial adhesion of its cut leading edge to the core will be effective for the fraction of a second required for that portion of the core to rotate the few degrees necessary to bring it within the shoe 66, after which the shoe will do whatever guiding is needed until the leading end of the web is covered by completion of the first wrap at the nip with pressure roll 15. This action is also promoted by the saw tooth cut pattern, since the resulting triangular tongues 65 of web material, which are more flexible than the full width of the web, will be fastened to the core along both edges thereof by the cutting water, and they will therefore have less tendency to spring away from the core than if the web were cut at right angles to its edges.

It will be apparent that the illustration of the saw tooth cutting pattern in FIG. 4 is somewhat diagrammatic, particularly in assuming instant acceleration of the jet nozzles to full speed, but whether each cut line is straight or partially curved is not material to the principle or practice of the invention. Also, optimum results under each particular set of operating circumstances may require some experimentation, particularly with respect to the size of the nozzle orifices and the pressure with which water is supplied thereto. By way of guidance in this respect, successful test results have been obtained with a variety of web materials using nozzle orifices 0.006 inch in diameter supplied with water under pressures in the range of 40,000 psi.

While the method herein described, and the form of apparatus for carrying this method into effect, constitute preferred embodiments of this invention, it is to be understood that the invention is not limited to this precise method and form of apparatus, and that changes may be made in either without departing from the scope of the invention which is defined in the appended claims.

What is claimed is:

1. In a winder for continuously winding a web material into rolls on successive cores, roll changing apparatus for cutting and transferring the web material from a full roll to an empty core, comprising:

(a) means for carrying an empty core into engagement with a run of the web material to a winding roll and for causing said core to rotate at a surface speed substantially matching that of the web material, (b) means including a least one nozzle on the opposite side of said web material from said core positioned to discharge a water jet toward a line of engagement between the web and said core, and (c) means for moving each said nozzle lengthwise of said core while discharging said jet therefrom, whereby each said jet severs the web material and simultaneously wets the resulting leading edge thereof and the surface area of said core adjacent said web edge.

2. Roll changing apparatus as defined in claim 1 further comprising at least one pair of said nozzles, and means for simultaneously moving one of said nozzles in each said pair in the opposite direction lengthwise of said core from the other said nozzle in said pair between a common limit position and limit positions spaced from each other, to sever the web material along both of said portions of said core.

3. In a winder for continuously winding a web material on successive cores, roll changing apparatus for cutting and transferring the web material from a full roll to an empty core, comprising:

(a) means for supporting an empty core adjacent a run of the web material to a winding roll and for causing said core to rotate at a surface speed substantially matching that of the web material, (b) means for guiding the web material into partially wrapping relation with said core, (c) means including a plurality of pairs of nozzles supported in spaced relation lengthwise of said core on the opposite side of the web material from said core and positioned to discharge a corresponding plurality of water jets toward said core which define a common line extending lengthwise of the surface of said core, (d) means for simultaneously moving all of said nozzles lengthwise of said core over a total distance substantially equal to the width of the web material while discharging water jets therefrom, (e) said moving means including means for causing one of said nozzles in each said pair to move between respective limit positions in the opposite direction from the other said nozzle in said pair, and (f) each of said nozzles having at least one limit position which it shares with at least one of said oppositely moving nozzles, (g) whereby said jets sever the web material and simultaneously wet the leading edge thereof and the surface area of said core adjacent said web edge.

4. Roll changing apparatus as defined in claim 3 further comprising means interconnecting one of said nozzles in each said pair with one said nozzle in each other said pair to form a first manifold, means interconnecting the other said nozzles to form a second manifold, and means supporting each of said manifolds for reciprocating movement lengthwise of said core, and means for causing simultaneous movement of said manifolds in opposite directions.

5. The method of cutting and transferring web material being wound into a roll from a full roll to an empty core which comprises the steps of:

(a) bringing an empty core into engagement with a run of said web material traveling to a winding roll, (b) causing said core to rotate at a surface speed substantially matching that of said web material, (c) directing a plurality of water jets against said core through said web material while moving said jets lengthwise of said core to sever said web material and simultaneously to wet the resulting leading edge thereof and the surface area of said core adjacent said web edge.

6. The method defined in claim 5 which comprises the further step of directing a second plurality of water jets against said core through said web material while moving said jets lengthwise of said core in the opposite direction from said first plurality of jets between limit positions which each jet in said second plurality shares with at least one of said jets in the first set of plurality to complete the severing of said web material while simultaneously wetting the resulting leading edge thereof and the surface area of said core adjacent said web edge.

* * * * *